US006104276A

United States Patent [19]

Choi

[11] Patent Number: 6,104,276

[45] Date of Patent: Aug. 15, 2000

[54] FBT, ITS BLEEDER RESISTOR, AND DEVICE FOR COUPLING BLEEDER RESISTOR

[75] Inventor: Dae Sung Choi, Kyungki-do, Rep. of Korea

[73] Assignee: Samsung Electro-Mechanics Co., Ltd., Kyungki-do, Rep. of Korea

[21] Appl. No.: 09/273,375

[22] Filed: Mar. 22, 1999

[51] Int. Cl.[7] ..... H01C 3/12

[52] U.S. Cl. ..... 338/293; 338/283

[58] Field of Search ..... 338/283, 284, 338/292, 287, 288, 289, 280

[56] References Cited

U.S. PATENT DOCUMENTS

| | | | |
|---|---|---|---|
| 2,878,357 | 3/1959 | Thomson et al. | 201/73 |
| 4,220,893 | 9/1980 | Miller et al. | 313/450 |
| 4,450,347 | 5/1984 | Courvoisier et al. | 219/549 |
| 5,204,655 | 4/1993 | Yajima et al. | 338/312 |

FOREIGN PATENT DOCUMENTS 95-011766 5/1995 Rep. of Korea .

*Primary Examiner*—Lincoln Donovan
*Assistant Examiner*—Richard K. Lee
*Attorney, Agent, or Firm*—Renner, Otto, Boisselle & Sklar, LLP

[57] ABSTRACT

An FBT (fly-back transformer), its bleeder resistor (installed on the top of the FBT), and a device for coupling the bleeder resistor are disclosed. The bleeder resistor 100 is accommodated within a resistor case 180, and the resistor case 180 is installed on the top of an FBT case 110. A resistor pattern 140 is printed on the substrate 130 of the bleeder resistor 100. Openings 150 are formed within the wavy portions of the resistor pattern 140, and the resistor case 180 has a plurality of isolating sheets 160 within its interior 170, so that the isolating sheets 160 can be inserted into the openings 150. When manufacturing the bleeder resistor, the glass coating, the baking, the epoxy resin dipping are eliminated, but the voltage breakdown resisting property is improved. Further, the manufacturing cost is lowered owing to the simplification of the process.

5 Claims, 5 Drawing Sheets

FBT, ITS BLEEDER RESISTOR, AND DEVICE FOR COUPLING BLEEDER RESISTOR

BACKGROUND OF THE INVENTION

1. Field of the Invention

The present invention relates to an FBT (fly-back transformer), its bleeder resistor (installed on the top of the FBT), and a device for coupling the bleeder resistor, the FBT being for generating a high voltage in cathode ray tube for use in television, monitor or the like. Particularly, the present invention relates to an FBT, its bleeder resistor, and a device for coupling the bleeder resistor, in which two or more openings are formed adjacently to a resistance pattern on a substrate, and the first and second openings are formed alternately and mutually facingly. Further, the sum total of the lengths of the first and second openings is made larger than the average distance between the first and second openings. Thus, when manufacturing the non-coated bleeder resistor, there are not needed the glass coating, the baking, the dipping into the epoxy resin, and the curing. Notwithstanding, the voltage resistant property is reinforced, and the manufacturing process is simplified. Thus the bleeder resistor can be manufactured in an easy manner with a decreased cost.

2. Description of the Prior Art

Generally, the conventional bleeder resistor is manufactured in the following manner. That is, as shown in FIG. 1, there is prepared a ceramic substrate 10 made of $Al_2O_3$ having a purity of about 96%. Its thickness is about 0.5–1.2 mm, and its area is 400–1500 $mm^2$. Upon the ceramic substrate 10, there is printed PbAg, PtAg, Ag or their combination paste. Then the printed substrate is baked at a temperature of about 800° C., and thus, a printed circuit board is formed, and then lead wires are soldered. Then $RuO_2$ is printed thereupon, and then the structure is baked at a temperature of about 850° C. Thus a resistor having a certain thickness is completed.

Meanwhile, in this resistor, electric current can flow only if the electrical resistance per unit length of the resistor is smaller than the air contact electrical resistivity. In the case where the voltage breakdown resistivity of air is 0.5 KV/mm, if a voltage of 20 KV is supplied across a resistor 12, there has to be secured a distance of 20 KV÷0.5 KV/mm=40 mm. Further, if the thermal degradation and the environmental factors are taken into account, then the safe distance must be 1.8 times as large as the above distance, that is, 40 mm×1.8=72 mm. Meanwhile, in the case where the resistor 12 is printed on the ceramic substrate 10 in a straight line, the length of the ceramic substrate has to be longer, with the result that the total bulk of the ceramic substrate becomes too large.

Therefore, the resistor 12 on the ceramic substrate 10 has to be made curved, so as to reduce the bulk of the ceramic substrate 10. In this case, however, the potential difference over per unit length of the curved pattern exceeds the straight line voltage breakdown resisting distance 0.5 KV/mm. If the environmental factors and the thermal degradation are taken into account, the potential difference per unit length far more exceeds the air voltage breakdown resisting distance, with the result that glow discharges may occur between the curved patterns. Therefore, conventionally after forming the curved resistor, the resistor patterns are insulated by a glass coating, and then, a sealed baking is carried out, thereby preventing the occurrence of the glow discharges.

Meanwhile, although the glass coating can insulate the patterns, the moisture and the thermal impact during the curing of the crystalline epoxy resin weakens the insulation, or damage the bleeder. Therefore, a dipping into the epoxy resin is carried out after the glass coating.

However, the bleeder resistor manufactured in the above method is accompanied by the following disadvantages.

First, the resistor 12 is printed upon the ceramic substrate 10, then a glass coating is carried out, then a baking is carried out, then the epoxy resin 15 is coated, and then its curing is carried out. Therefore, due to this complicated manufacturing process, the productivity is lowered, and the manufacturing cost rises.

Second, the resistor 12 is printed upon the ceramic substrate 10, then a glass coating is carried out to insulate the resistor patterns, then a baking is carried out, then the epoxy resin 15 is coated, and then its curing is carried out. Therefore, the characteristics of the printed resistor 12 are degraded, and the resistance error fluctuation rate is increased.

Third, due to the continued baking, the grains of the resistor are continuously rearranged, and therefore are easily deranged. Therefore, the surface of the resistor becomes rough and sharp, with the result that the resistance against the voltage breakdown steeply drops.

Fourth, the resistance error become higher as described above, and therefore, to cater to the consumers, incomplete products are discarded. Ultimately, the product price has to be decided higher.

Fifth, due to the use of glass and soft epoxy resin, the material cost is increased, with the ultimate result that the price is further increased.

FIGS. 2A–2E illustrate various examples of the conventional bleeder resistors. The total area of the ceramic substrate 10 on which the resistor is printed is dipped into the molten epoxy resin to coat the substrate. FIG. 2A illustrates a bleeder resistor having three lead lines 14, the lead lines being connected by soldering. Therefore, this resistor has the above described disadvantages. FIG. 2B illustrates a bleeder resistor in which the resistor patterns are formed very densely, and only one face of the ceramic substrate is coated.

FIG. 2C illustrates another conventional bleeder resistor in which only a part of one face of the ceramic substrate is coated with silicon. FIG. 2D illustrates a bleeder resistor in which a focus volume substrate is formed integrally, the resistor 12 is coated with an epoxy resin, and an opening is formed at a part of the substrate. FIG. 2E illustrates an example in which the focus volume substrate is integrally formed (it is not a bleeder resistor), and the straight distance between the openings (which are for insulating the patterns) is smaller than the width (W) of the ceramic substrate.

In the above described conventional techniques, there are the above described disadvantages due to the adoption of the glass coating and the soft epoxy coating. Besides, even if there are openings, glow discharges occur between the patterns all the same when the voltage rises to the rated level. Further, as described above, the complicated processes bring the lowering of the workability and the productivity.

SUMMARY OF THE INVENTION

The present invention is intended to overcome the above described disadvantages of the conventional techniques.

Therefore it is an object of the present invention to provide an FBT and its bleeder resistor, in which the glass coating, the baking, the dipping into the epoxy resin, and its curing are all eliminated, but the voltage breakdown resisting property is improved, and the product can be easily manufactured owing to the simplification of the manufacturing process.

It is another object of the present invention to provide a bleeder resistor and a coupling device for the bleeder resistor, in which openings are formed between wavily curved resistor patterns so as to prevent glow discharges at a high voltage, and the bleeder resistor is inserted into a casing to perfectly insulate the resistor patterns, thereby improving the electrical characteristics of the bleeder resistor.

In achieving the above objects, the FBT bleeder resistor according to the present invention includes: a substrate, and a wavily curved resistor pattern formed on the substrate. The FBT bleeder resistor further includes: one or more pairs of openings formed in the substrate, each pair of the openings consisting of a first opening and a second opening; the first opening being open at on e edge of the substrate; the second opening being open at an opposite edge of the substrate; the first and second openings extending laterally on the substrate; and a sum total of lengths of the first and second openings being larger than an average width of the substrate between the first and second openings.

In another aspect of the present invention, the FBT bleeder resistor coupling device according to the present invention includes: a bleeder resistor; a resistor case for receiving the bleeder resistor having openings alternately and mutually facingly arranged; isolating sheets formed within the resistor case, for being inserted into the openings of the bleeder resistor, and projecting above the bleeder resistor; and a lid for covering the top of the resistor case, after the insertion of the bleeder resistor into the case.

In still another aspect of the present invention, the FBT according to the present invention includes: high voltage and low voltage bobbins, with coils being wound thereon for generating a high voltage; an FBT case for accommodating the high voltage and low voltage bobbins and filled with an insulating resin; a bleeder resistor including a resistance pattern; a bleeder resistor substrate having one or more pair of adjacently disposed first and second openings, the first opening being open at one edge of the substrate, the second opening being open at the opposite edge of the substrate, and a sum total of lengths of the first and second openings being larger than an average width of the substrate between the first and second openings; the resistance pattern extending wavily between the first and second openings; a resistor case for receiving the bleeder resistor, and having a plurality of isolating sheets for being inserted into the openings of the bleeder resistor and projecting above the bleeder resistor; and a lid for covering the top of the resistor case, after the insertion of the bleeder resistor into the case.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENTS

Figure 1:
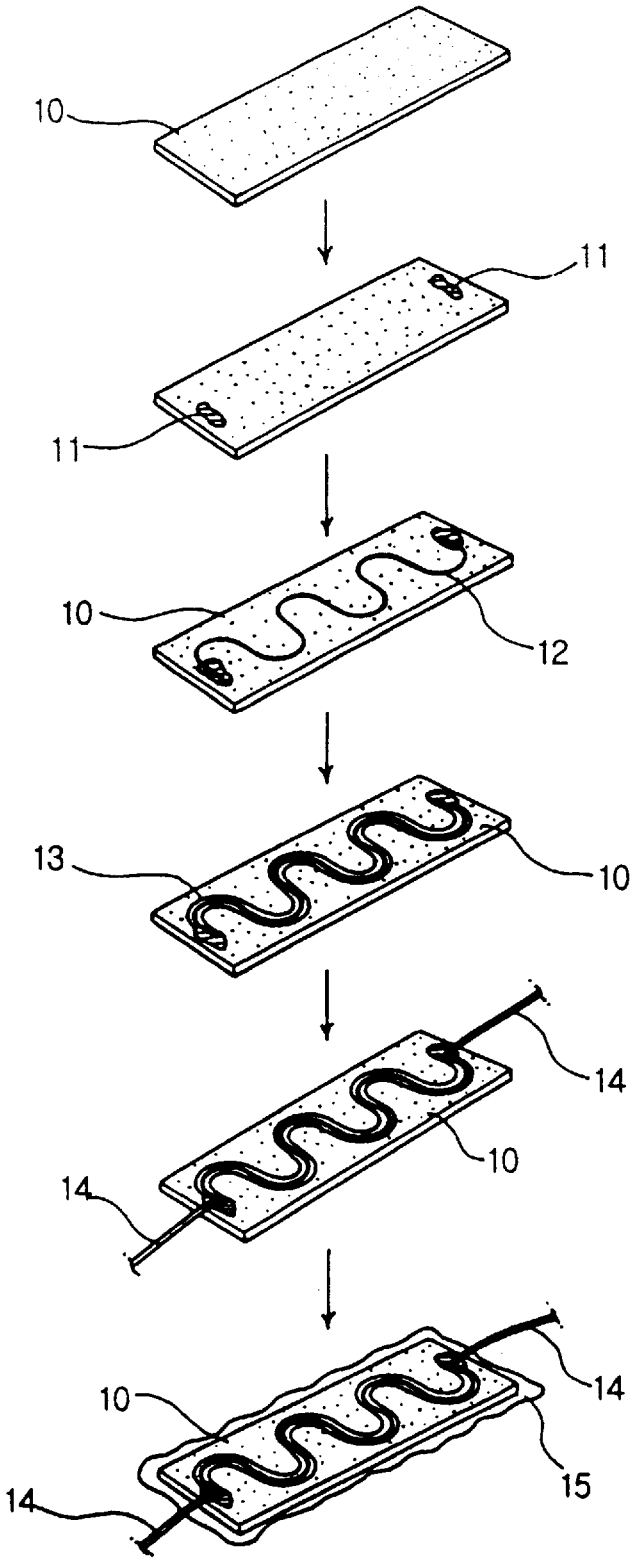
FIG. 1 Prior Art
FIG. 1 illustrates the manufacturing process for the general FBT bleeder resistor.
Figure 2:
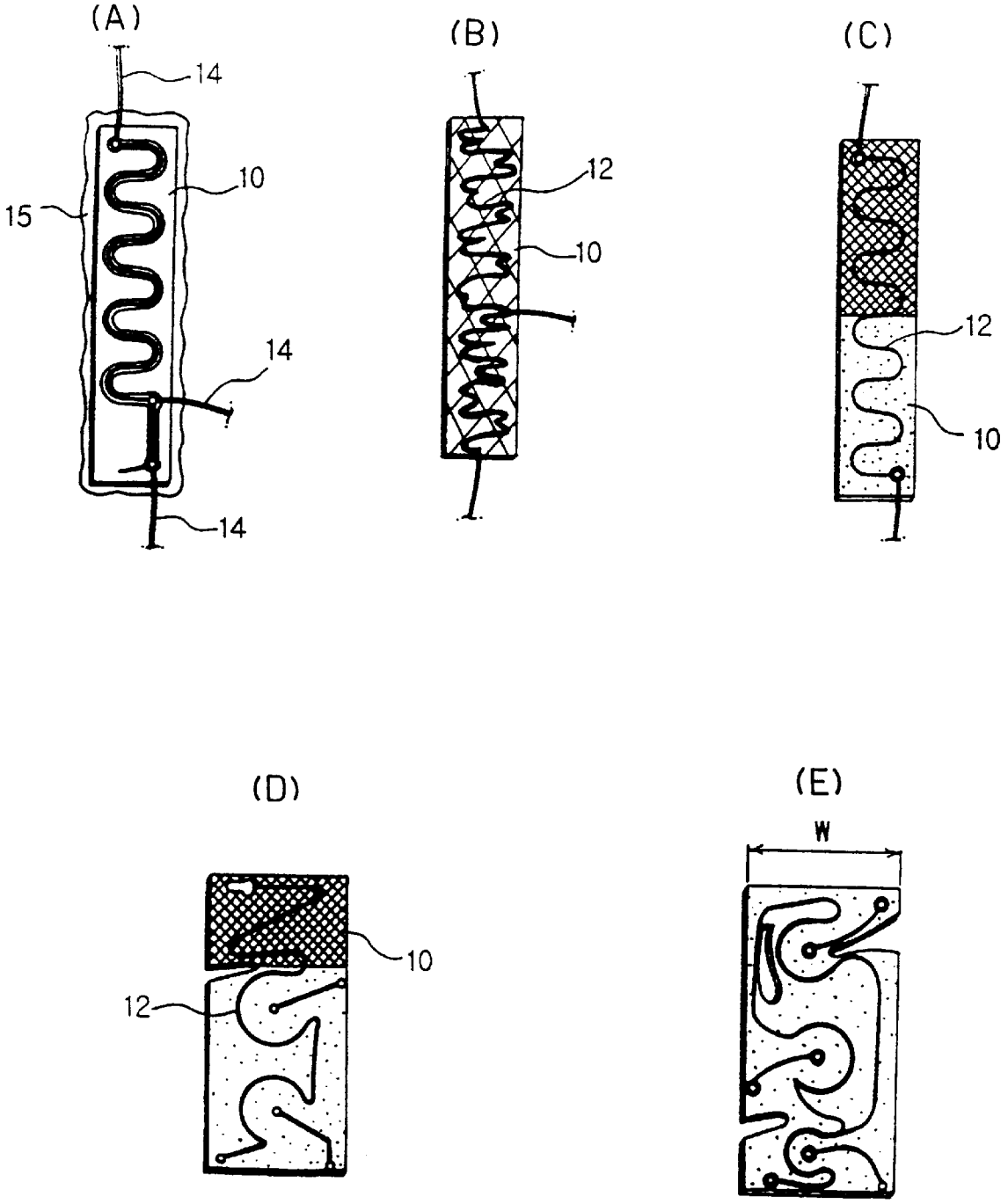
FIG. 2 Prior Art
FIGS. 2A–2E illustrate various examples of the bleeder resistors for use on the conventional FBT.
Figure 3:
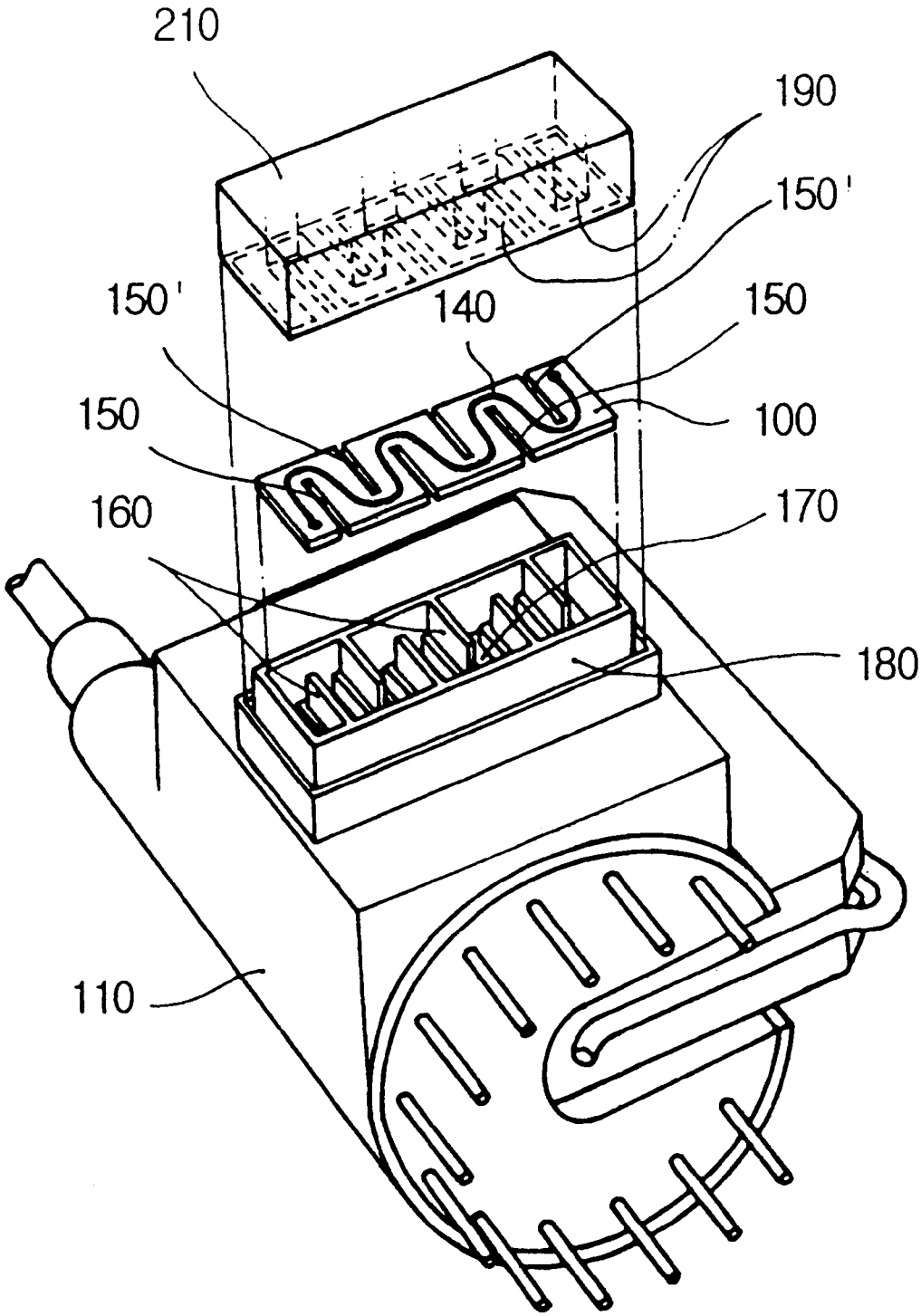
FIG. 3 is an exploded perspective view showing the FBT, the bleeder resistor and the lid according to the present invention.
Figure 4:
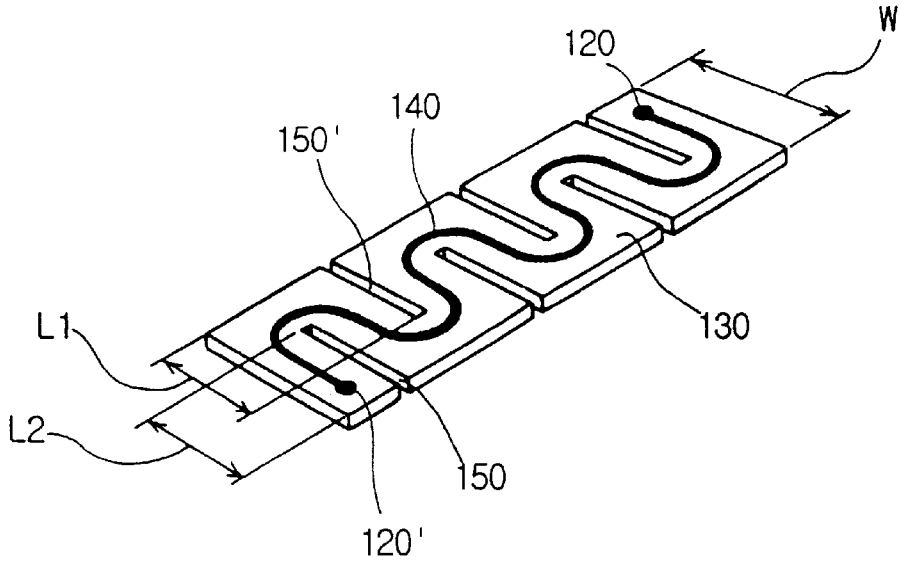
FIG. 4 is a perspective view showing the bleeder resistor according to the present invention.

FIG. 3 is an exploded perspective view showing the FBT, the bleeder resistor and the lid according to the present invention. FIG. 4 is a perspective view showing the bleeder resistor according to the present invention.

Inside the FBT of the present invention, there are high voltage and low voltage bobbins with coils would thereon. An FBT case 110 accommodates the high voltage and low voltage bobbins, and contains an insulating resin for insulating the high voltage and low voltage bobbins. On the top of the FBT case 110, there are installed a resistor case 180. The resistor case 180 accommodates a bleeder resistor 100 which includes a substrate 130 and a resistor pattern 140 formed on the substrate 130. The resistor case 180 is covered with a lid 210.

Figure 5:
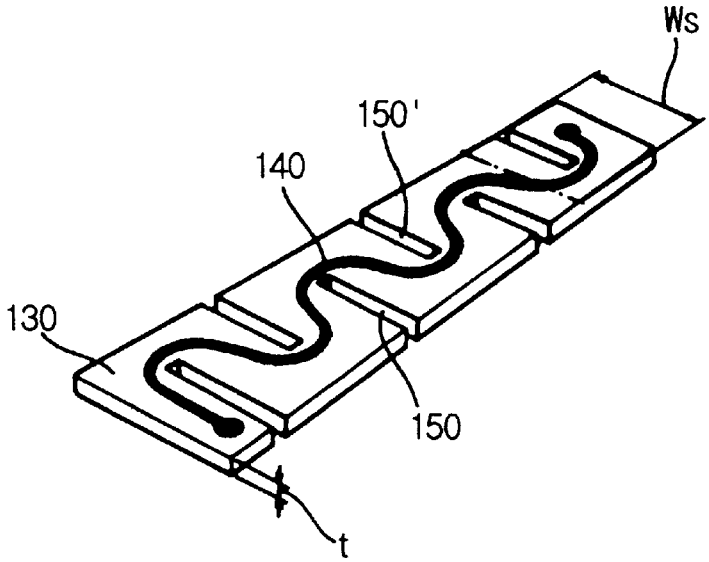
FIG. 5 is a perspective view showing another embodiment of the bleeder resistor according to the present invention.

As shown in FIGS. 4 and 5, the bleeder resistor 100 is formed such that a resistor pattern 140 is printed on the substrate 130, and that first and second openings 150 and 150' are formed alternately mutually facingly within the wavy portions of the resistor pattern 140.

That is, one or more pairs of the first and second openings 150 and 150' are formed adjacently to each other on the substrate 130. The first opening 150 is open at one edge of the substrate 130.

The second opening 150' is open at the opposite edge of the substrate 130, and the first and second openings 150 and 150' are formed laterally in the substrate 130. The sum total ($L_1$+$L_2$) of the lengths of the first and second openings 150 and 150' is made larger than an average substrate width Ws between the first and second openings 150 and 150'.

Figure 6:
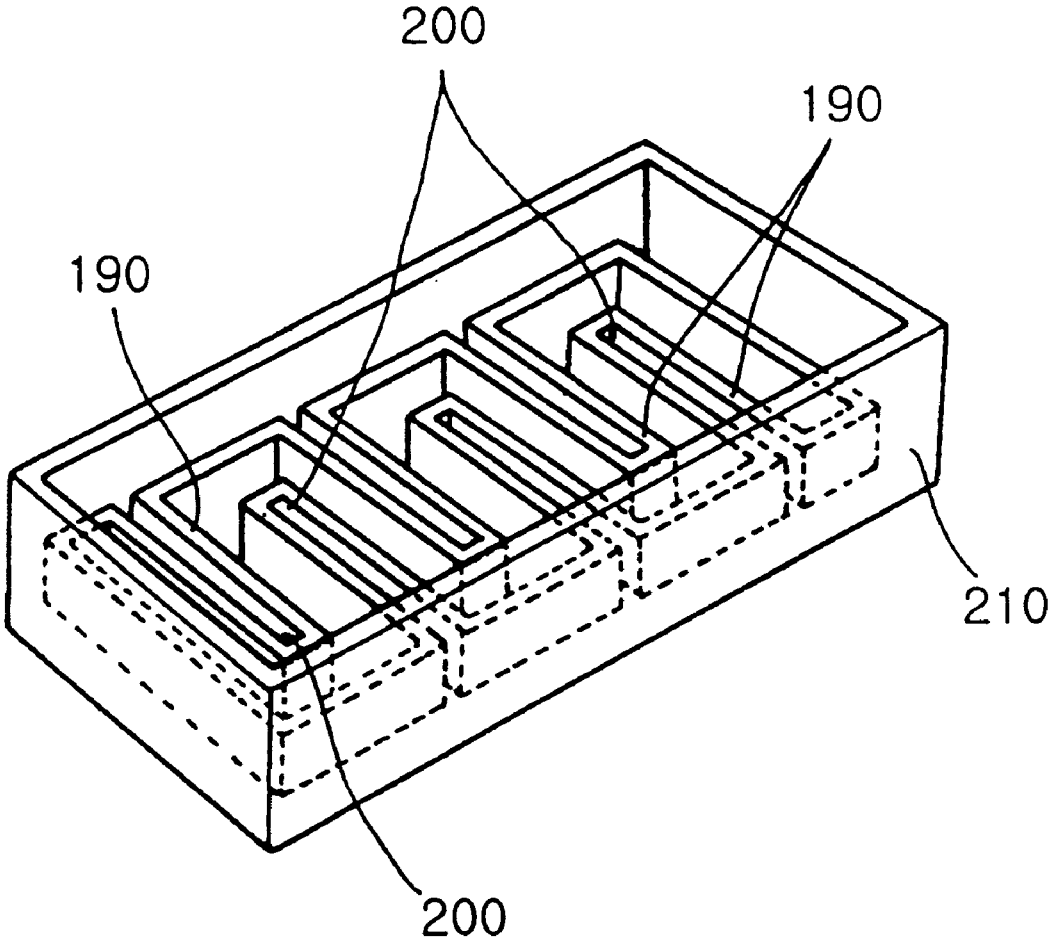
FIG. 6 is a perspective view showing the lid of the resistor case.

As shown in FIG. 3, on the top of the FBT case 110, there is installed a resistor case 180, and the resistor case 180 has a plurality of isolating sheets 160 within the interior 170 of the resistor case 180, so that the isolating sheets 160 can be inserted into the openings 150 and 150'. As shown in FIG. 6, a lid 210 is coupled to the resistor case 180, and has a plurality of insertion grooves 200, so that the lid can be coupled to the resistor case 180. The insertion grooves 200 are formed by the surrounding walls 190.

The present invention constituted as above will now be described as to its action and effects.

As shown in FIGS. 3 to 6, the resistor case 180 is installed on the top of the FBT case 110, and the bleeder resistor 100 is installed within the resistor case 180. On the substrate 130 of the bleeder resistor 100, there is printed a wavy (sweep) resistor pattern 140. Within the adjacent wavy portions of the resistor pattern 140, there are formed openings 150 and 150' of a certain depth, and the openings are for insulation.

As shown in FIG. 4, within the wavy portions of the resistor pattern 140 which is printed on the substrate 130 of the bleeder resistor 100, there are formed at least one or more pairs of the first and second openings 150 and 150'. Further, the first opening 150 is open at one edge of the substrate 130, and the second opening 150' is open at the opposite edge of the substrate 130.

The first and second openings 150 and 150' are formed laterally in the substrate 130, and the sum total ($L_1$+$L_2$) of the lengths of the first and second openings 150 and 150' is made larger than the average substrate width Ws between the first and second openings 150 and 150'. Thus through between the oppositely open first and second openings 150 and 150', the resistor pattern 140 can be printed in a wavy (sweep) form. Thus sufficient insulating distances are secured, and more reinforced insulation is ensured owing to the openings 150 and 150'.

FIG. 5 is a perspective view showing another embodiment of the bleeder resistor according to the present invention. In this case, the width of the substrate 130 is not constant, but the pairs of the first and second openings 150 and 150' are properly formed laterally in the substrate 130. Further, the sum total ($L_1$+$L_2$) of the lengths of the first and second openings 150 and 150' is made larger than the average substrate width Ws between the first and second openings 150 and 150'.

As shown in FIG. 3, if the bleeder resistor 100 is to be conveniently installed on the top of the FBT case 110, the resistor case 180 having the isolating sheets 160 has to be installed on the top of the FBT case 110. The resistor case 180 not only secures the bleeder resistor 100 but also reinforces the insulating characteristics of the bleeder resistor 100.

That is, a plurality of the isolating sheets 160 are formed within the resistor case 180, so that the isolating sheets 160 can be precisely mated with the openings 150 and 150'. Thus not only the bleeder resistor 100 can be firmly secured, but also the wavy portions of the printed resistor pattern 140 can be perfectly insulated from each other. Here the height of the isolating sheets 160 has to be larger than the thickness t of the substrate 130.

Meanwhile, as shown in FIG. 6, the lid 210 is for covering the resistor case 180, and the lid 210 has a plurality of surrounding walls 190 to form a plurality of insertion grooves 200. After the bleeder resistor 100 is installed within the resistor case 180, the lid 210 is fitted to the resistor case 180, with the isolating sheets 160 being closely mated with the insertion grooves 200 of the lid 210.

Therefore, if a high voltage is supplied to an input terminal of the resistor pattern 140 (which is printed on the ceramic substrate 130), the voltage drops across the resistor pattern 140. Under this condition, glow discharges do not occur owing to the isolating sheets 160 which come between the wavy portions of the resistor pattern 140.

For example, if a voltage of 20 KV(dc) is supplied to the input terminal 120 of the resistor pattern 140, and if the ceramic substrate 130 has a width of 10 mm and a length of 30 mm, then the total length of the resistor pattern 140 becomes 80 mm. If the air voltage breakdown resisting limit of 0.5 KV/mm and the environmental factors and the thermal degradation are taken into account, then a factor of 1.8 is needed. That is, 0.5 KV/mm÷1.8 KV/mm=0.28 KV/mm has to be maintained, and therefore, 20 KV(dc)÷0.28 KV/mm=71.4 mm is needed. Meanwhile the resistor pattern 140 has a length of 80 mm, and therefore, a sufficient resistance is ensured. Further, the wavy portions of the resistor pattern 140 are isolated by the isolating sheets 160, and therefore, any glow discharge can be prevented.

Thus a perfect insulation is achieved, and therefore, the conventional glass coating becomes needless. Therefore, the bleeder resistor can be used under the air, and therefore, the conventional resin dipping which causes cracks needs not be carried out.

In order to prevent the intrusion of moisture, a final sealing is carried out after installing the bleeder resistor and after fitting the lid 210 to the resistor case 180. The final sealing is carried out by dipping the completed FBT into epoxy resin, thereby perfectly insulating the FBT from the outside. Thus the bleeder resistor is not influenced by the contraction phenomenon of the conventional epoxy resin coating. Further, the final coating such as glass coating and epoxy resin dipping has to be done even on the soldered lead lines. Further, the input terminal 120 and the output terminal 120' of the resistor pattern 140 can be made of a contact spring or an insulating rubber.

According to the present invention as described above, when manufacturing the bleeder resistor of the FBT, the glass coating, the baking, the soft epoxy resin dipping and the curing are eliminated. However, the voltage breakdown resisting property is improved. The simplification of the manufacturing process makes it possible to manufacture the bleeder resistor in an easy manner, and the manufacturing cost is significantly lowered. Further, the openings are formed within the wavy portions of the curved resistor pattern on the substrate, and therefore, any glow discharge can be prevented. The bleeder resistor with the openings formed is accommodated within the resistor case having isolating sheets, in such a manner that the isolating sheets are inserted into the openings of the bleeder resistor. Thus the wavy portions of the curved resistor pattern are perfectly insulated from each other, thereby further improving the electrical characteristics of the bleeder resistor.

What is claimed is:

1. An FBT bleeder resistor comprising: a substrate having opposite edges and a face extending between said opposite edges, and a wavily curved resistor formed on said face of said substrate, said substrate having formed therein one or more pairs of openings including a first opening and a second opening;

said first opening being open at one edge of said substrate;

said second opening being open at an opposite edge of said substrate;

said first and second openings extending laterally across said face of said substrate between respective relatively adjacent portions of said wavily curved resistor; and a sum total of lengths of said first and second openings being larger than an average width of said substrate between said first and second openings.

2. The FBT bleeder resistor as claimed in claim 1, wherein said openings of said ceramic substrate are defined by straight parallel sides.

3. The FBT bleeder resistor as claimed in claim 1, wherein said openings formed in said substrate are formed within the wavily curved portions of said curved resistor pattern.

4. The FBT bleeder resistor as claimed in claim 1, wherein said openings of said ceramic substrate are in the form of slots extending perpendicular to the side edges of the substrate to which they open.

5. The FBT bleeder resistor as claimed in claim 2, wherein said openings formed in said substrate are formed within the wavily curved portions of said curved resistor pattern.

* * * * *